US008448821B2

(12) United States Patent
Hecht

(10) Patent No.: US 8,448,821 B2
(45) Date of Patent: May 28, 2013

(54) SANITARY COLLECTION DEVICE FOR USE WITH A BEVERAGE DISPENSER

(75) Inventor: Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 947 days.

(21) Appl. No.: 12/043,073

(22) Filed: Mar. 5, 2008

(65) Prior Publication Data

US 2008/0217357 A1 Sep. 11, 2008

Related U.S. Application Data

(60) Provisional application No. 60/893,213, filed on Mar. 6, 2007.

(51) Int. Cl.
*B67D 1/16* (2006.01)

(52) U.S. Cl.
USPC ..... 222/108; 222/538

(58) Field of Classification Search
USPC ..... 222/108, 180, 179.5, 567, 129.1, 222/109–111, 530, 538, 566, 192; 141/86; 248/79; 137/312, 313, 314; 220/719
See application file for complete search history.

(56) References Cited

U.S. PATENT DOCUMENTS

| | | | | | |
|---|---|---|---|---|---|
| 194,596 | A * | 8/1877 | Gold | 222/108 |
| 1,866,466 | A * | 7/1932 | Hassensall | 222/108 |
| 2,144,004 | A * | 1/1939 | Wilson | 62/258 |
| 2,871,675 | A * | 2/1959 | Cornelius | 62/258 |
| 4,703,768 | A | 11/1987 | Lee | |
| 5,063,977 | A * | 11/1991 | Belland | 141/86 |
| 5,152,429 | A * | 10/1992 | Billings | 222/129.2 |
| 5,165,574 | A | 11/1992 | Ratcliffe | |
| 5,305,924 | A * | 4/1994 | Groover et al. | 222/129.1 |
| 5,395,013 | A * | 3/1995 | Billings | 222/132 |
| 6,189,720 | B1 * | 2/2001 | Gillispie | 220/571 |
| 2008/0093384 | A1 * | 4/2008 | Fire et al. | 222/144.5 |
| 2009/0277927 | A1 * | 11/2009 | Schroeder et al. | 222/108 |

* cited by examiner

*Primary Examiner* — Kevin P Shaver
*Assistant Examiner* — Robert Nichols, II
(74) *Attorney, Agent, or Firm* — Kilpatrick Townsend & Stockton LLP

(57) ABSTRACT

A sanitary collection device for a beverage dispenser that provides an improved and larger collection area as compared to a cylindrical holster; and separation between the dispensing nozzle of the beverage dispenser and collection surfaces of the sanitary collection device such that the dispensing nozzle is prevented from contacting a possibly contaminated surface of the sanitary collection device. The present invention also provides for easy cleaning of the sanitary collection device and its drip cup, since the drip cup can be easily removed without the use of tools to facilitate cleaning and/or replacement.

22 Claims, 15 Drawing Sheets

SANITARY COLLECTION DEVICE FOR USE WITH A BEVERAGE DISPENSER

CROSS-REFERENCES TO RELATED APPLICATIONS

This application claims the benefit under 35 U.S.C. §119 (e) of U.S. Provisional Patent Application No. 60/893,213, filed Mar. 6, 2007, the full disclosure of which is incorporated herein by reference.

BACKGROUND OF THE INVENTION

The present invention is related to beverage dispensers, and more specifically to a sanitary collection device for beverage dispensers.

Currently, the drainage from a beverage dispensing device, such as a bar gun either falls into a sink over which the device is positioned for that specific purpose, an ice-bin, or a collection device sometimes referred to as a bar gun holster.

FIGS. 1A, 1B, and 1C show a known bar gun 12 (or beverage dispenser) that is placed in its holster 14. Such a bar gun 12 and holster 14 set up is commercially available from the assignee of this patent application.

FIG. 1A depicts the general position of the dispensing nozzle 16 of the bar gun 12 as it is being inserted into the holster 14, while being supported by the operator's hand. FIG. 1B depicts the at-rest (or unsupported) position of the bar gun 12 when stowed in the holster 14. The weight of the tubing bundle (not shown) attached to the bar gun 12, along with location of the center of gravity of the bar gun 12 relative to the holster 14, can cause the dispensing nozzle 16 to come into direct contact with the potentially contaminated interior surface 18 of the holster 14. The holster-based solution includes a generally cylindrical member that is configured to accept and encompass the nozzle of the bar gun, and provide a collection device for fluid discharged by the bar gun. This collection device may or may not be fitted with a drainage means, such as the drain line 20 shown. Additionally, while the collection device does provide for collection of fluid discharged from the dispensing nozzle 16 of the bar gun 12, continued use may cause a build-up on the interior surface 18 of the holster 14 as the fluids dry. Furthermore, if not regularly attended to, the interior surface 18 of the collection device can provide a medium for the growth of bacteria and/or molds. The size of the collection device can also readily allow for contact between the dispensing nozzle 16 and the inner surface 18 of the collection device, and thus potentially contaminating the dispensing nozzle through which the next beverage is dispensed to a customer.

There is therefore a need to provide a storage and drainage solution for a bar gun that does not suffer from the above shortcomings.

BRIEF SUMMARY OF THE INVENTION

The present invention provides a sanitary collection device for a beverage dispenser that provides an improved and larger collection area as compared to a cylindrical holster; and separation between the dispensing nozzle and collection surfaces such that the nozzle is prevented from contacting a potentially contaminated surface. The present invention also provides for easy cleaning of the sanitary collection device and its drip cup, since the drip cup can be easily removed without the use of tools to facilitate cleaning and/or replacement of the drip cup, as well as other parts of the sanitary collection device.

Thus, in one aspect, the present invention provides a sanitary collection device for fluid discharged from a beverage dispenser. The sanitary collection device can include, for example, a drip cup that is removable without the use of tools, the drip cup having a drain spout, a bottom side that channels water to the drain spout, and surrounding walls. The sanitary collection device can further include a drip cup holder adapted to be secured relative to a stowed beverage dispenser, receive and support the drip cup in a position beneath the stowed beverage dispenser, and provide separation between the drip cup and the stowed beverage dispenser.

The present invention may be embodied in a number of different variations. In an exemplary variation, the drip cup holder may include a drip cup holder spout, a drip cup holder bottom side coupled with the drip cup holder spout, and surrounding drip cup holder walls coupled with the drip cup bottom side, where the drip cup holder is sized to cooperatively receive the drip cup and align the drip cup drain spout with the drip cup holder spout.

In further exemplary variations, the drip cup of the present invention may further include an attachment feature adapted to interface with a mating attachment feature on the drip cup holder. For example, the attachment features may include t-shaped protrusions configured to interface with slotted recesses. Additionally, the sanitary collection device may further comprise a beverage dispenser holder and be configured to be clamped to a countertop.

Additionally, certain embodiments of the present invention may further include additional items, such as a drain line, and/or a beverage dispenser holder. The drip cup holder may further include an attachment flange for coupling with a beverage dispenser holder. The attachment flange may include a channel configured to interface with a portion of a beverage dispenser holder. The attachment flange may further include one or more mounting holes for attachment fasteners.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

DETAILED DESCRIPTION OF THE INVENTION

The invention described herein provides a sanitary collection device for use with beverage dispensers. The sanitary collection device disclosed generally provides a means by which the discharge of a beverage dispenser may be collected and drained. The disclosed sanitary collection device provides a collection area of increased size relative to existing bar gun holsters. The disclosed sanitary collection device further provides separation between collection surfaces of the sanitary collection device and the dispensing nozzle of the beverage dispenser, thereby precluding contamination of the dispensing nozzle that might occur as a result of contact with potentially contaminated surfaces. Additionally, the presently disclosed sanitary collection device incorporates a collection area in the form of a drip cup that is easily removable without the use of tools, thereby facilitating cleaning and/or replacement. The removal of the drip cup further facilitates the cleaning of the other components of the disclosed sanitary collection device.

Figure 1C:
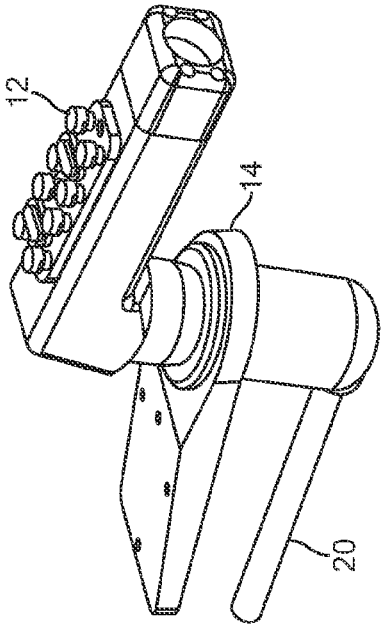
FIG. 1C (PRIOR ART)
FIG. 1C shows a perspective view of the known bar gun and cylindrical holster of FIG. 1A.
Figure 1A:
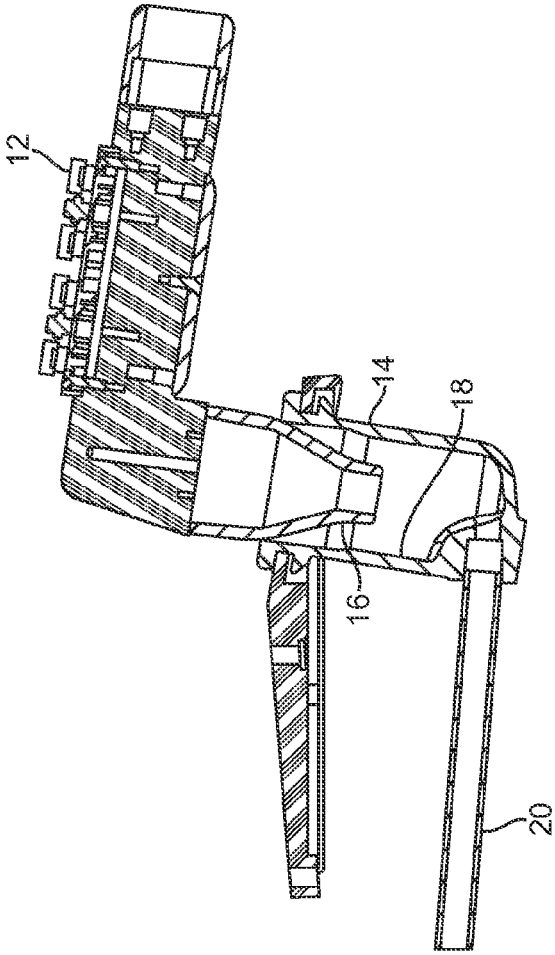
FIG. 1A (PRIOR ART)
FIG. 1A shows a known bar gun positioned relative to a cylindrical holster as held during its insertion into the holster.
Figure 1B:
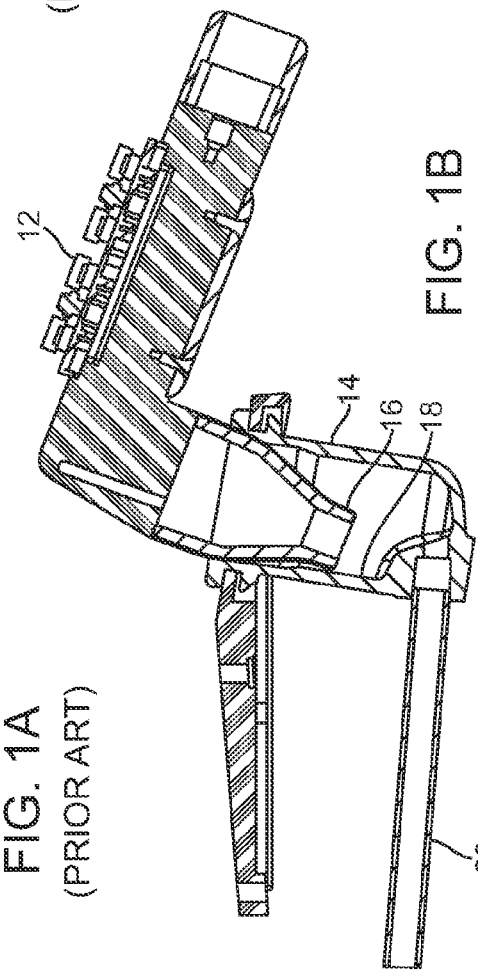
FIG. 1B (PRIOR ART)
FIG. 1B shows a typical position for a known bar gun relative to a cylindrical holster after it has been released.
Figure 2:
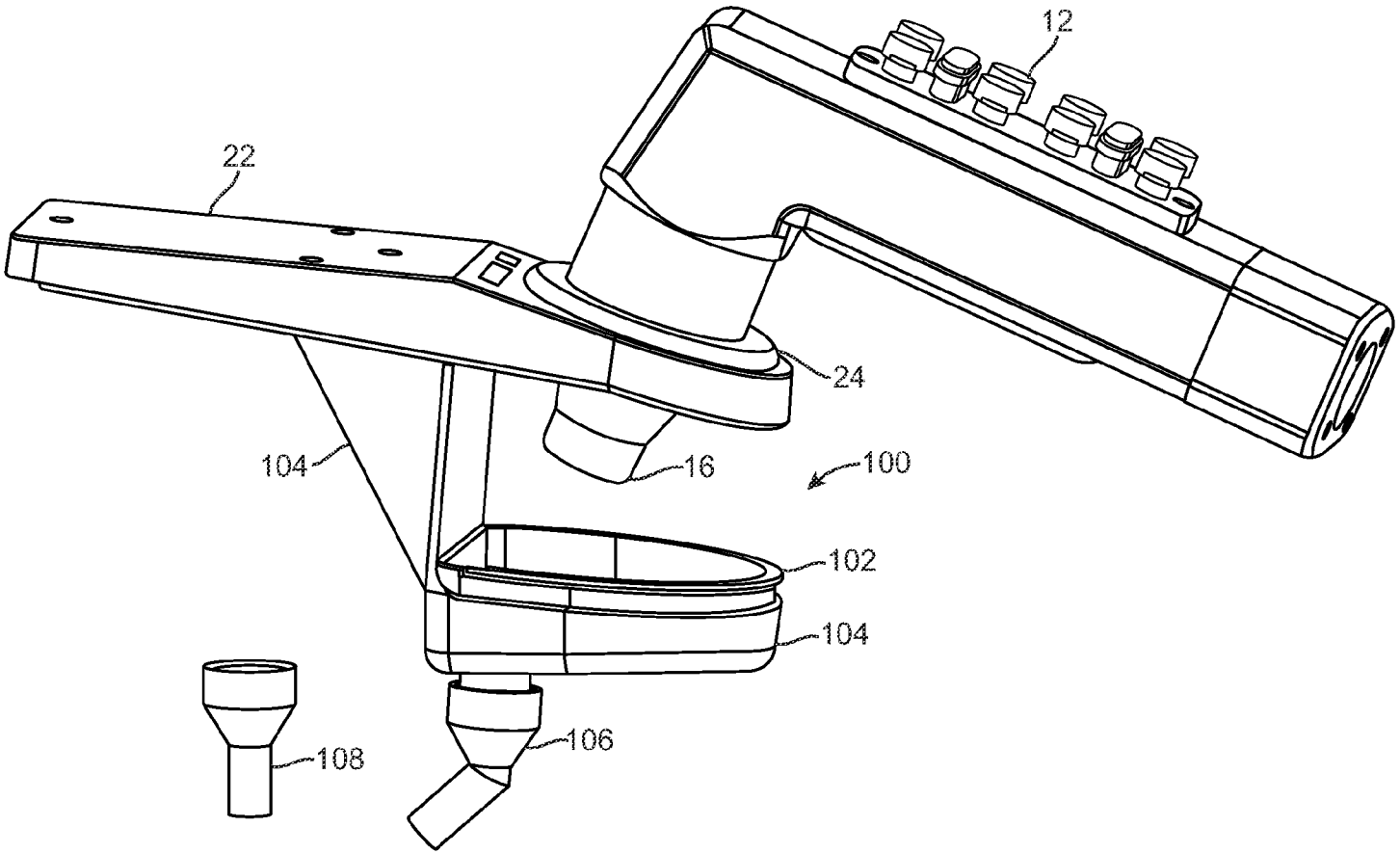
FIG. 2 is a perspective view of a sanitary collection device in accordance with one embodiment of the present invention used in combination with a molded bar gun holder.

FIGS. 2-5 contain assorted views corresponding to a first embodiment of the present inventive sanitary collection device 100. FIG. 2 is a perspective view of a sanitary collection device 100 in accordance with one embodiment of the present invention used in combination with a molded bar gun holder 22. As shown, the beverage dispenser 12 is stowed in the molded bar gun holder 22, with the beverage dispenser 12 being held stationary by way of contact with the grommet 24 disposed around the opening 26 in the molded bar gun holder 22. As can be seen, the collection area, or drip cup 102, of the sanitary collection device 100 is positioned relative to the dispensing nozzle 16 so as to avoid contact with the dispensing nozzle 16, while providing an adequate catch basin for any fluid discharged from the dispensing nozzle 16. Fluid discharged from the dispensing nozzle is collected by the sanitary collection device and drained by way of the attached angled fitment 106, to which a drain tube (not shown) may be attached. Alternatively, the straight fitment 108 shown adjacent to the attached angled fitment 106 may be used in place of the attached angled fitment 106.

Figure 3:
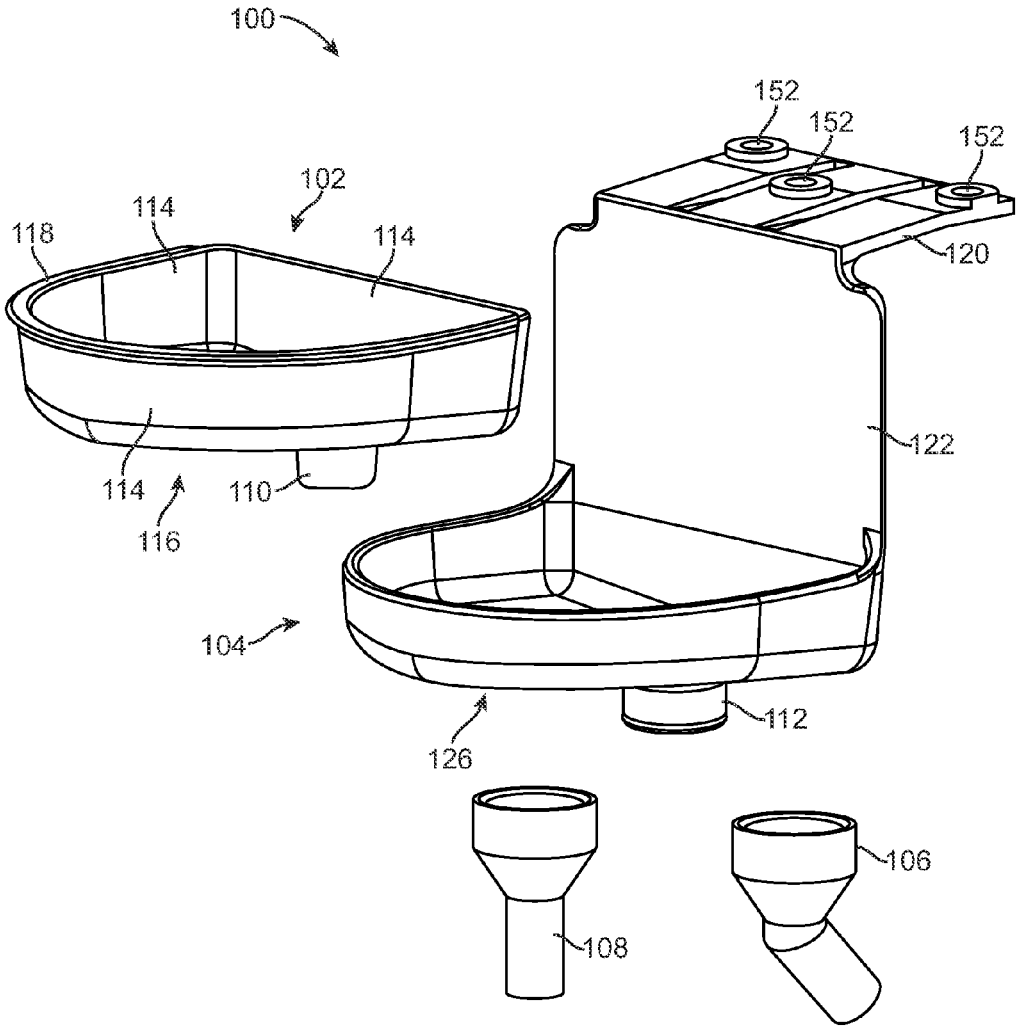
FIG. 3 is an exploded view of the sanitary collection device of FIG. 2 in which the mounting and support means of the sanitary collection device and its drip cup is provided with a means for accepting either a straight or angled fitment to which a drainage tube may be attached.

FIG. 3 provides an exploded perspective view of the sanitary collection device 100 in accordance the embodiment of the present invention of FIG. 2 in which the mounting and support means of the sanitary collecting device is provided with a means for accepting either a straight fitment 108 or an angled fitment 106 to which a drain tube (not shown) may be attached. As can be seen in FIG. 3, the sanitary collection device 100 can include a drip cup 102, a drip cup holder 104 and either a straight fitment 108 or an angled fitment 106. The drip cup 102 and the drip cup holder 104 are complementarily shaped such that the drip cup 102 fits in the drip cup holder 104 and the drip cup drain spout 110 gets aligned and fits in the drip cup holder spout 112. The drip cup 102 is shaped such that it has walls 114 that extend upwards at the periphery of the drip cup bottom side 116 and includes a drip cup drain spout 110 that extends downward from the drip cup bottom side 116. The drip cup 102 and the drip cup holder 104 may be designed with interfacing features, such as the drip cup support lip 118 shown, which interfaces with the top surface of the drip cup holder walls 128 so as to provide stable support of the drip cup 102. The drip cup bottom side 116 is concave and angled or pitched to drain toward the drip cup drain spout 110. The drip cup holder 104 is dimensioned to receive the drip cup 102 and has a shape similar to that of the drip cup. The drip cup holder may be configured to enable it to be coupled with a bar gun holder. For example, the drip cup holder may be configured with an attachment portion, such as the attachment flange 120 having mounting holes 152 as shown. The attachment flange 120 may be connected with the drip cup holder bottom side 126 by way a back wall 122. Drain tube adapters, such as the straight fitment 108 or the angled fitment 106 shown, may be coupled with the drip cup holder spout 112 by a snap and/or a friction fit and can swivel about the drain cup holder spout 112. The sanitary collection device 100 can be made from a plastic material by a molding process. The sanitary collection device can also be made of any material that is suitable for the operating conditions.

Figure 4:
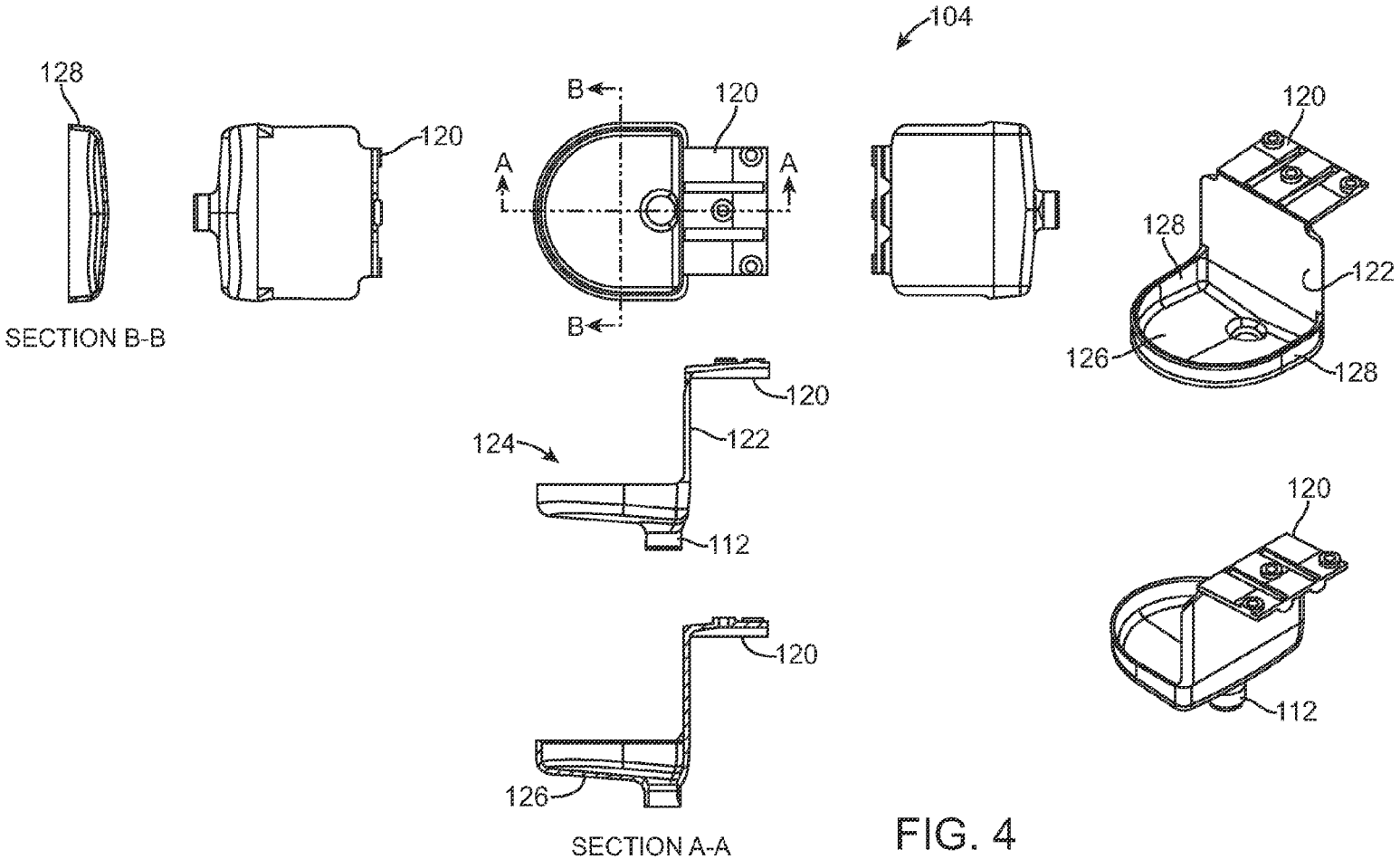
FIG. 4 contains assorted views that show the holder for the drip cup of FIGS. 2 and 3.

FIG. 4 contains assorted views that show the drip cup holder 104 of FIGS. 2 and 3. As shown, the drip cup holder 104 includes: a) an attachment flange 120 configured to be coupled with a bar gun holder; b) a drip cup receiving portion 124 for receiving the drip cup 102, the drip cup receiving portion 124 including a drip cup holder bottom side 126 and peripheral drip cup holder walls 128; c) a downwardly extending drip cup holder spout 112 for connection with the above described angled fitment 106 or straight fitment 108; and d) a back wall 122 that joins the attachment flange 120 with the drip cup receiving portion 124.

Figure 5:
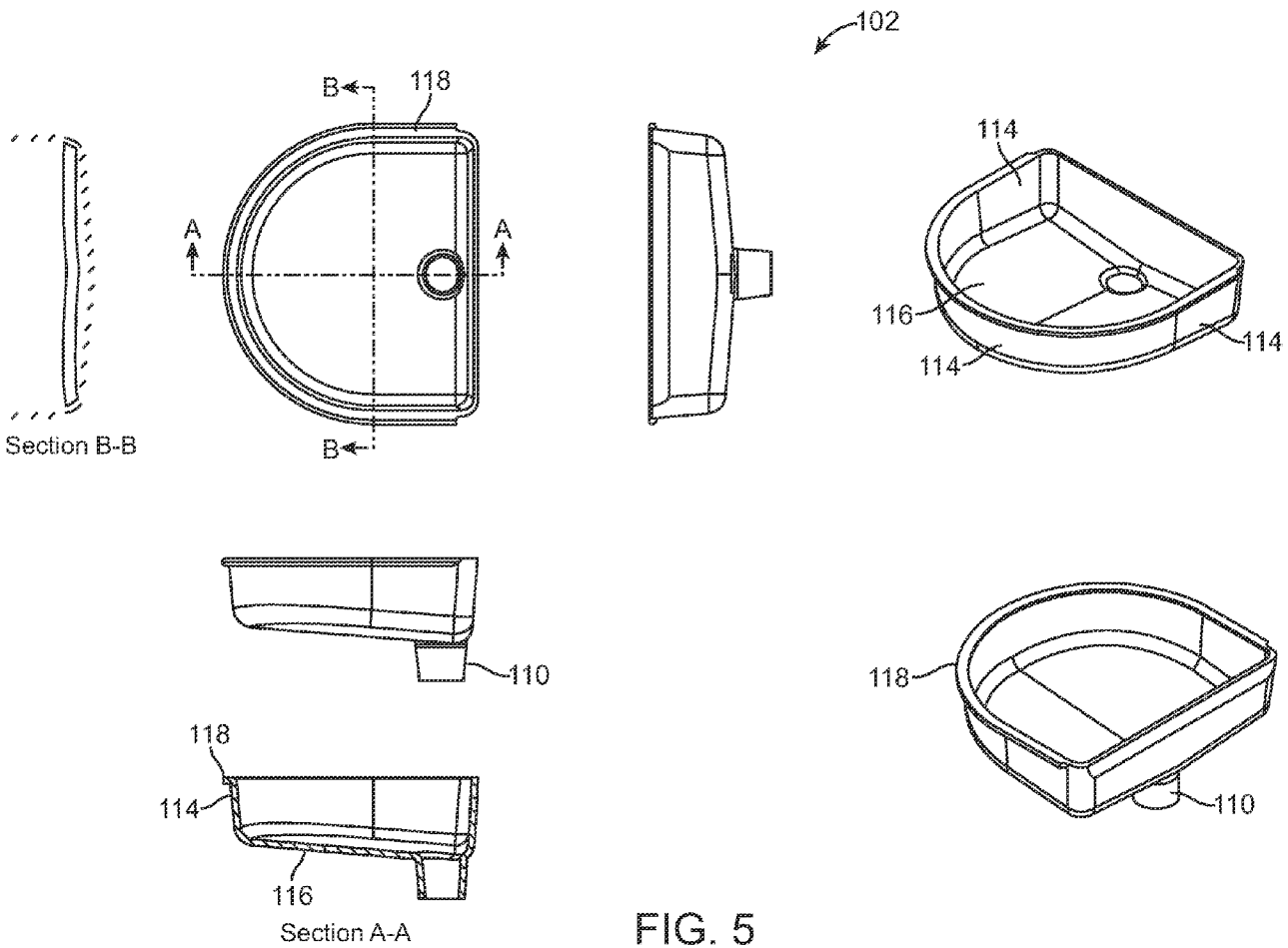
FIG. 5 contains assorted views that show the drip cup of FIGS. 2 and 3.

FIG. 5 contains assorted views that show the drip cup 102 of FIGS. 2 and 3. As shown, the drip cup 102 includes: a) a downwardly extending drip cup drain spout 110; b) a drip cup bottom side 116 that is generally sloped toward the drip cup drain spout 110 so as to channel collected fluid to the drip cup drain spout 110; c) surrounding drip cup walls 114 extending upwardly from the periphery of the drip cup bottom side 116; and d) a perimeter lip 118 for engagement with the top of the drip cup receiving portion 124 of the drip cup holder 104 as described above.

Figure 6:
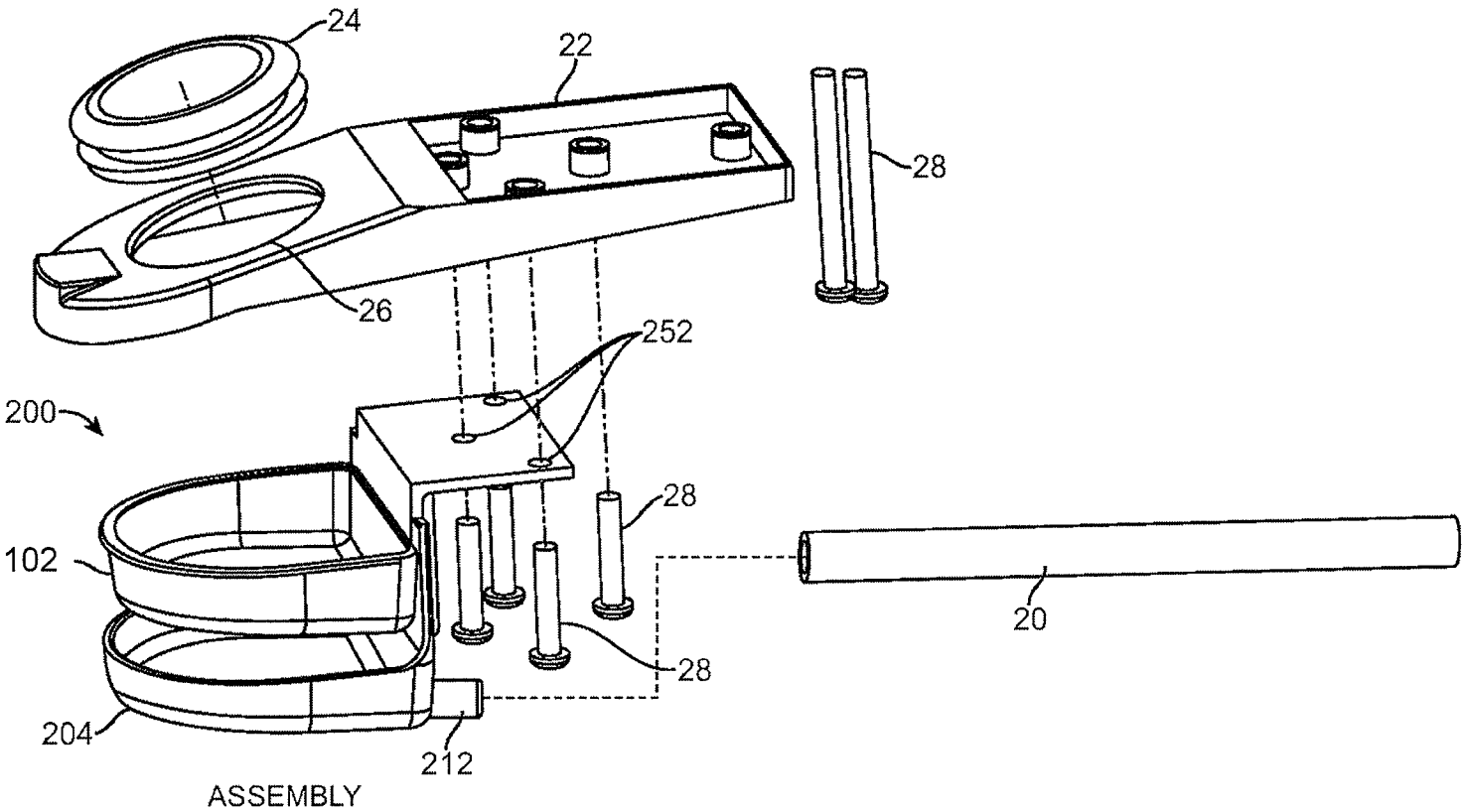
FIG. 6 is an exploded perspective view of a sanitary collection device in accordance with another embodiment of the present invention used in combination with a molded bar gun holder and a drain line.
Figure 7:
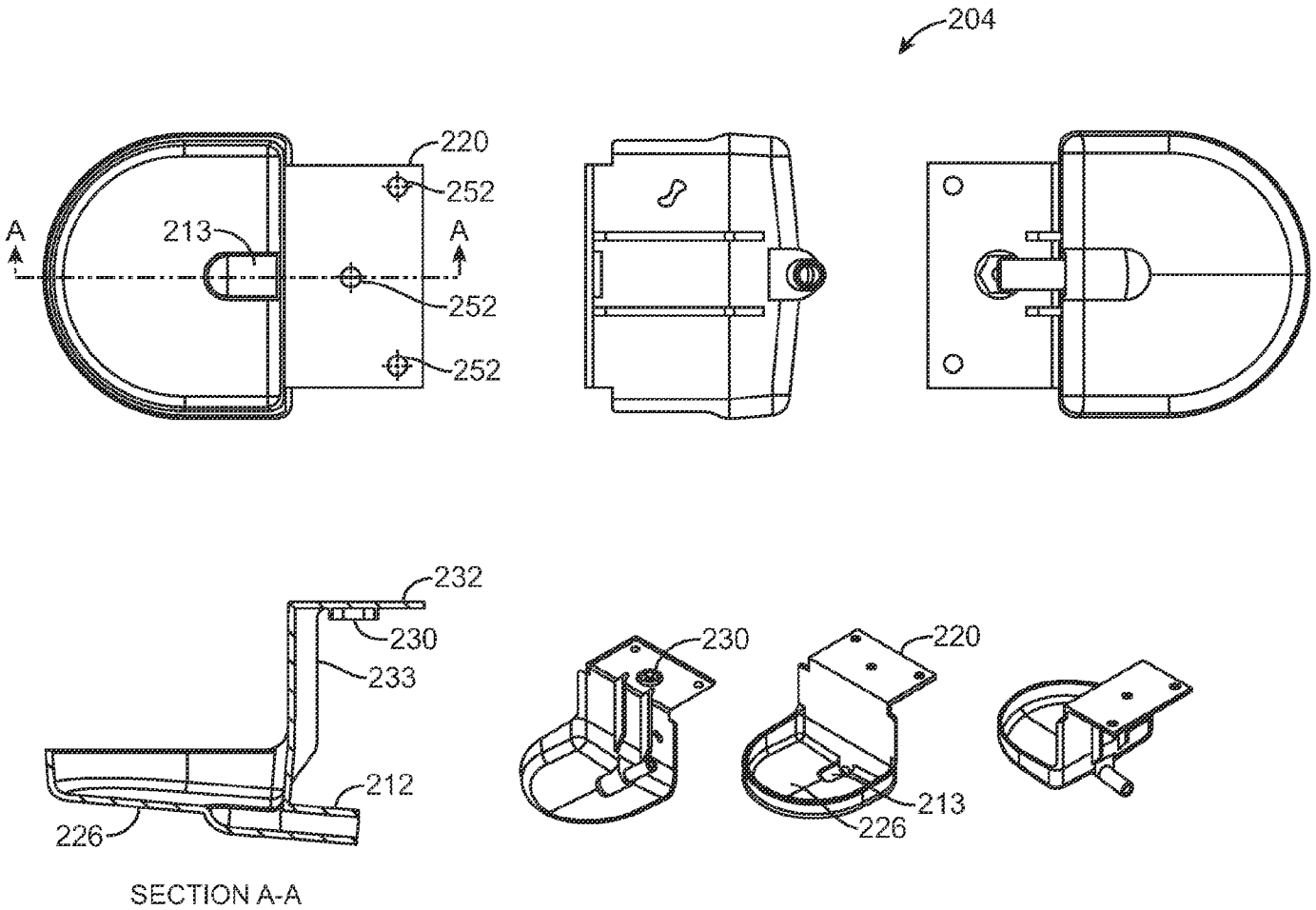
FIG. 7 contains assorted views that show the holder for the drip cup of FIG. 6.

FIG. 6 is an exploded perspective view of a sanitary collection device 200 in accordance with another embodiment of the present invention used in combination with a molded bar gun holder 22 and a drain line 20. The embodiment of FIG. 6 is similar to the embodiment of FIGS. 2 through 5, but incorporates a horizontally extending drip cup holder spout 212 with a correspondingly configured drip cup drain spout thereby providing for a routing of the drain line 20 beneath the countertop (not shown). Recess 213 shown in FIG. 7 is provided as a transition between the horizontally extending drip cup holder spout 212 and the drip cup holder bottom side 226. Additionally, recess 213 can provide space for a drip cup drain spout (not shown) that is configured to drain fluid by way of the horizontally extending drip cup holder spout 212. FIG. 6 further shows the molded bar gun holder opening 26 and associated grommet 24 that interfaces with the stowed beverage dispenser (not shown), as well as representative attachment fasteners 28 used to couple the sanitary collection device 200 with the molded bar gun holder 22. FIG. 7 contains assorted views that show the drip cup holder 204 of FIG. 6, which has similar features to the drip cup holder 104 of FIGS. 2 through 5, except for the above noted difference with regard to the drip cup holder spout 212. Drip cup holder 204 has an attachment flange 220 with a flat interface 232 for mounting to the underside of a countertop or the like, as well as a fastener anti-rotation feature 230 to facilitate installation. Drip cup holder 204 may also include reinforcing gussets adapted to strengthen and/or stiffen portions of drip cup holder 204 as may be appropriate, such as the reinforcing gussets 233 shown.

Figure 8:
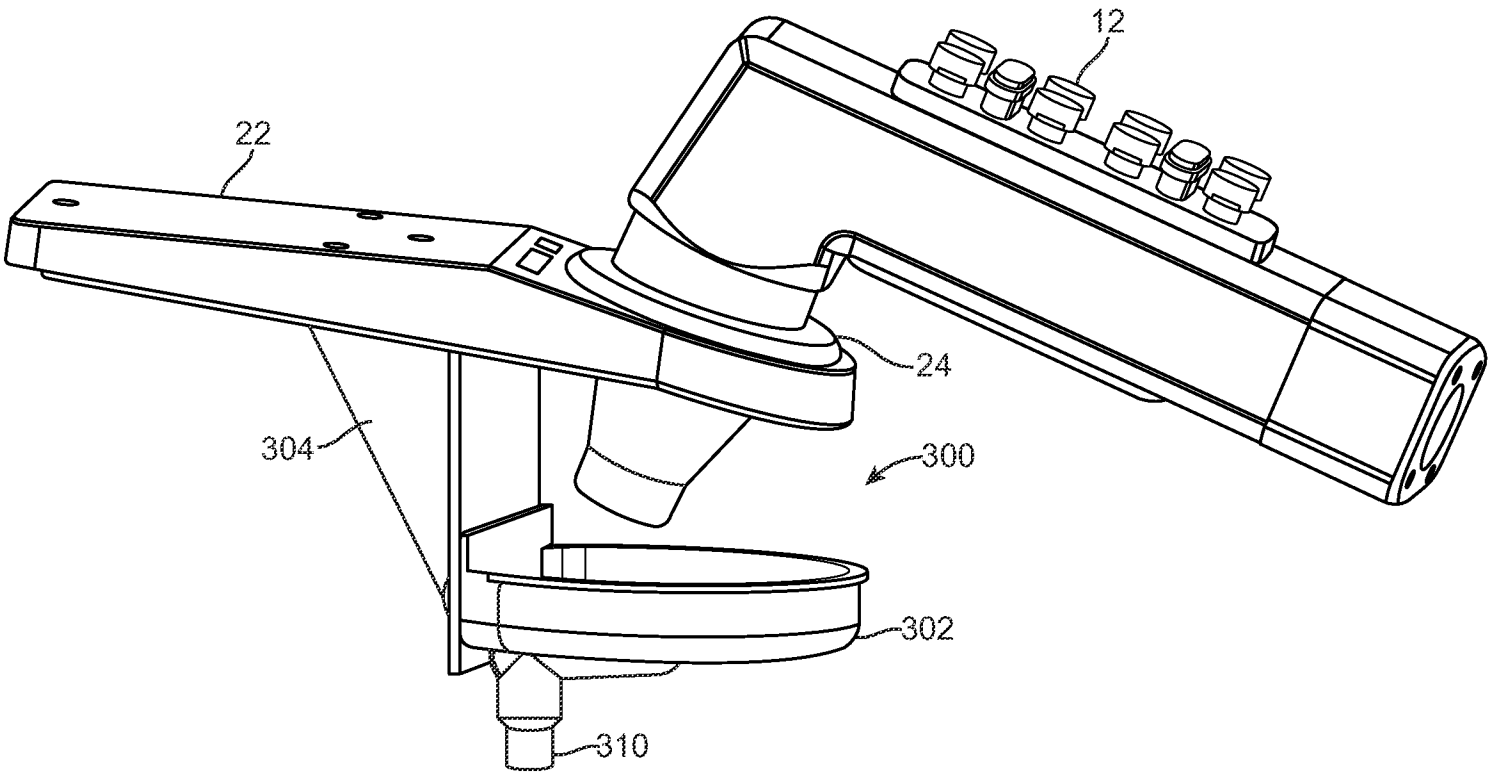
FIG. 8 is a perspective view of a sanitary collection device in accordance with another embodiment of the present invention used in combination with a molded bar gun holder.

FIG. 8 is a perspective view of a sanitary collection device 300 in accordance with another embodiment of the present invention used in combination with a molded bar gun holder 22 and associated grommet 24. In this embodiment, the drain line (not shown) is connected directly to the drip cup 302 instead of to the drip cup holder 304 as in the embodiments of FIGS. 2 through 7. In the embodiment of FIG. 8, an alternative interface between the drip cup 302 and the drip cup holder 304 is provided. As can be best seen in FIGS. 9 through 12, the drip cup 302 in this embodiment has t-shaped protrusions 334 that interlock with slotted keyways 336 located in the drip cup holder 304. As a result, the t-shaped protrusions 334 of the drip cup 302 can fit into the slotted keyways 336 of the drip cup holder 304 thereby providing a means to demountably couple the drip cup 302 with the drip cup holder 304. The drip cup 302 is shaped such that it has walls 314 that extend upwards at the periphery of the drip cup bottom side 316 and includes a drip cup drain spout 310 that extends downward from the drip cup bottom side 316. The drip cup bottom side 316 is concave and angled or pitched to drain fluid toward the drip cup drain spout. The drip cup and the drip cup holder include complementarily-shaped portions that fit against one-another. For example, the drip cup back portion 338 is straight and so can fit against the vertical flat wall 322 of the drip cup holder. The drip cup holder may further include reinforcing gussets 340 between the attachment flange 320 and the vertical flat wall 322 to strengthen and/or stiffen the drip cup holder 304, as may be desirable in part in view of the localized forces that may be present at the interfacing portions of the drip cup and the drip cup holder.

Figure 9:
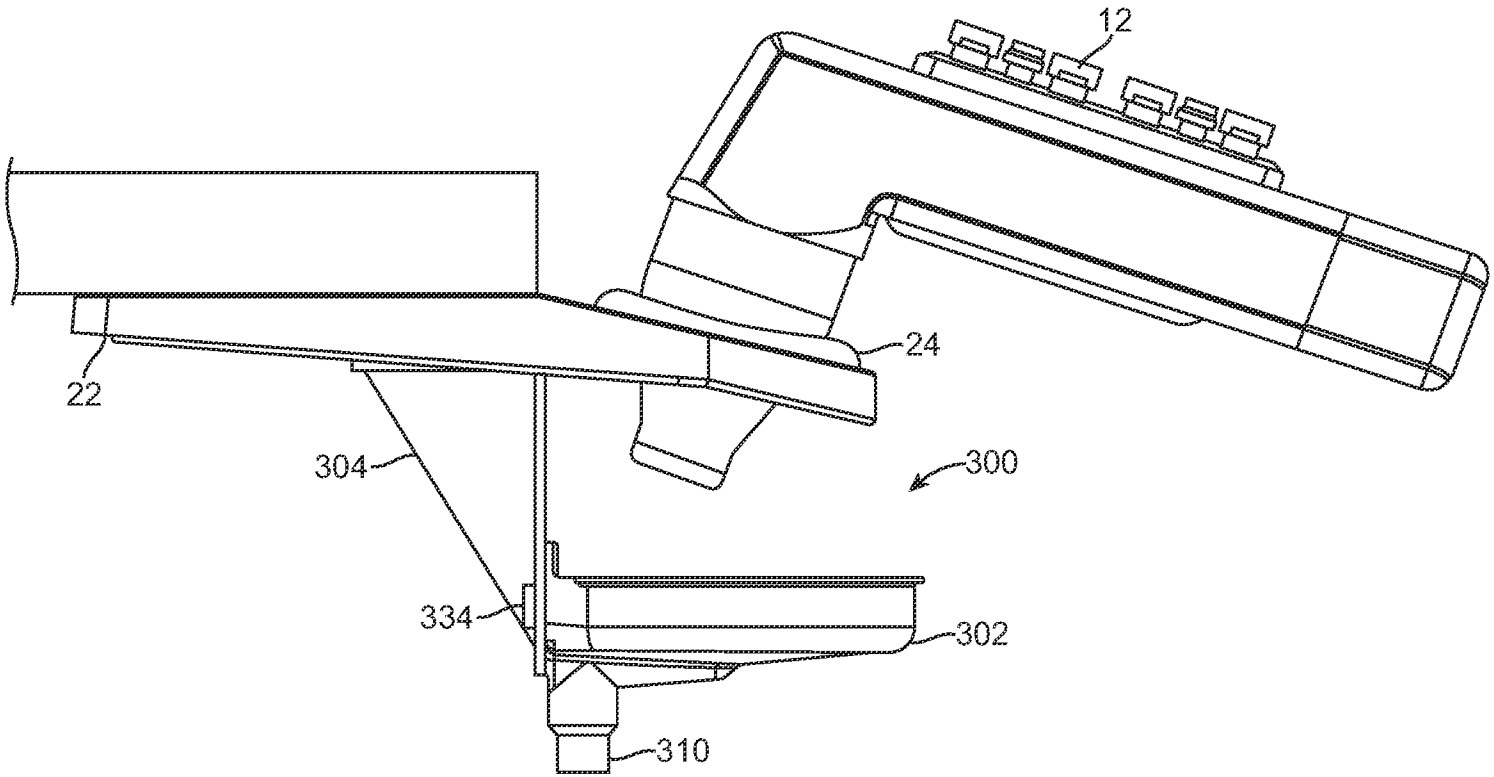
FIG. 9 is a side view of a sanitary collection device and molded bar gun holder of FIG. 8, shown mounted to the underside of a countertop.
Figure 10:
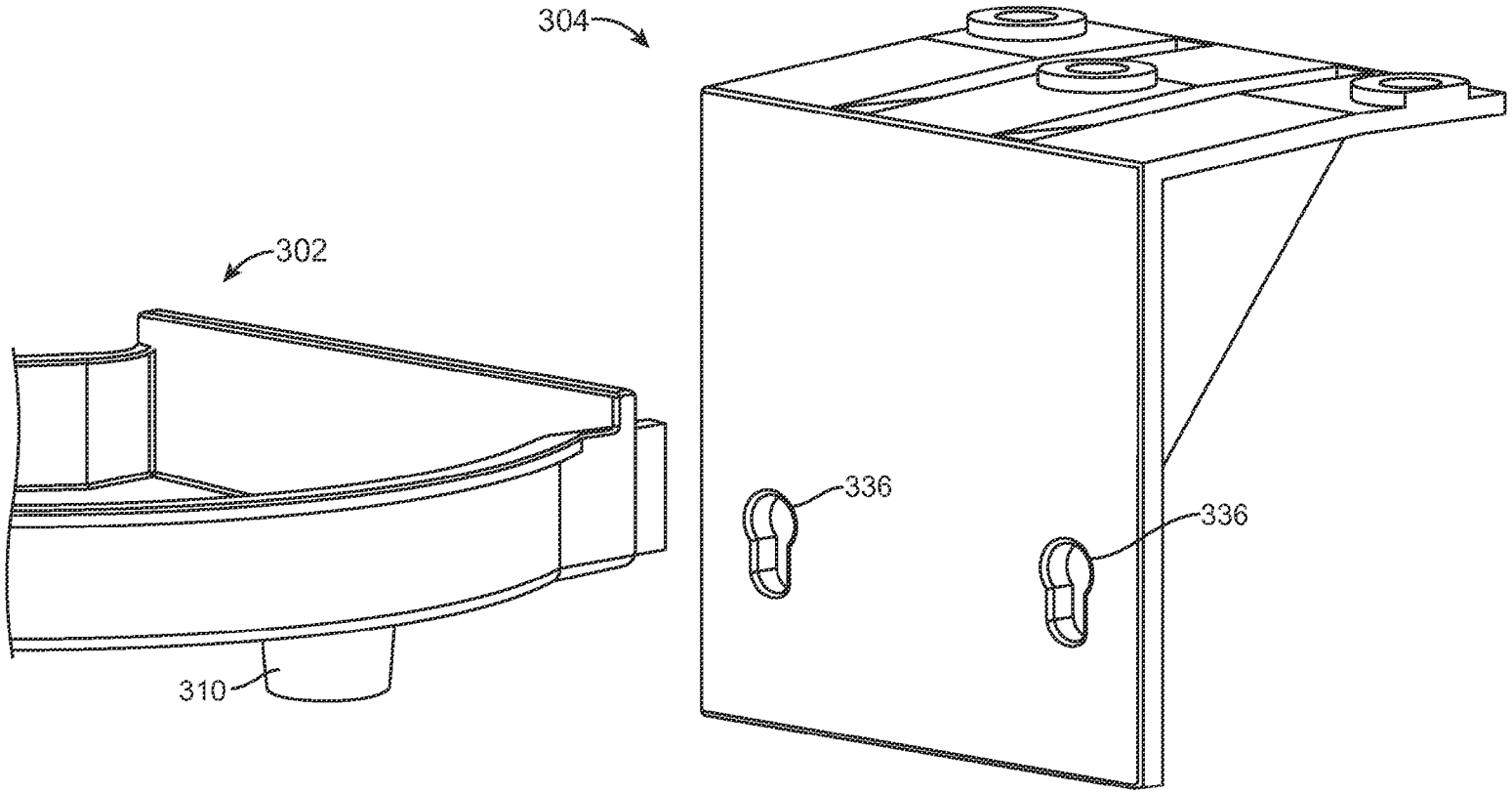
FIG. 10 is an exploded perspective view of the sanitary collection device of FIGS. 8 and 9.
Figure 11:
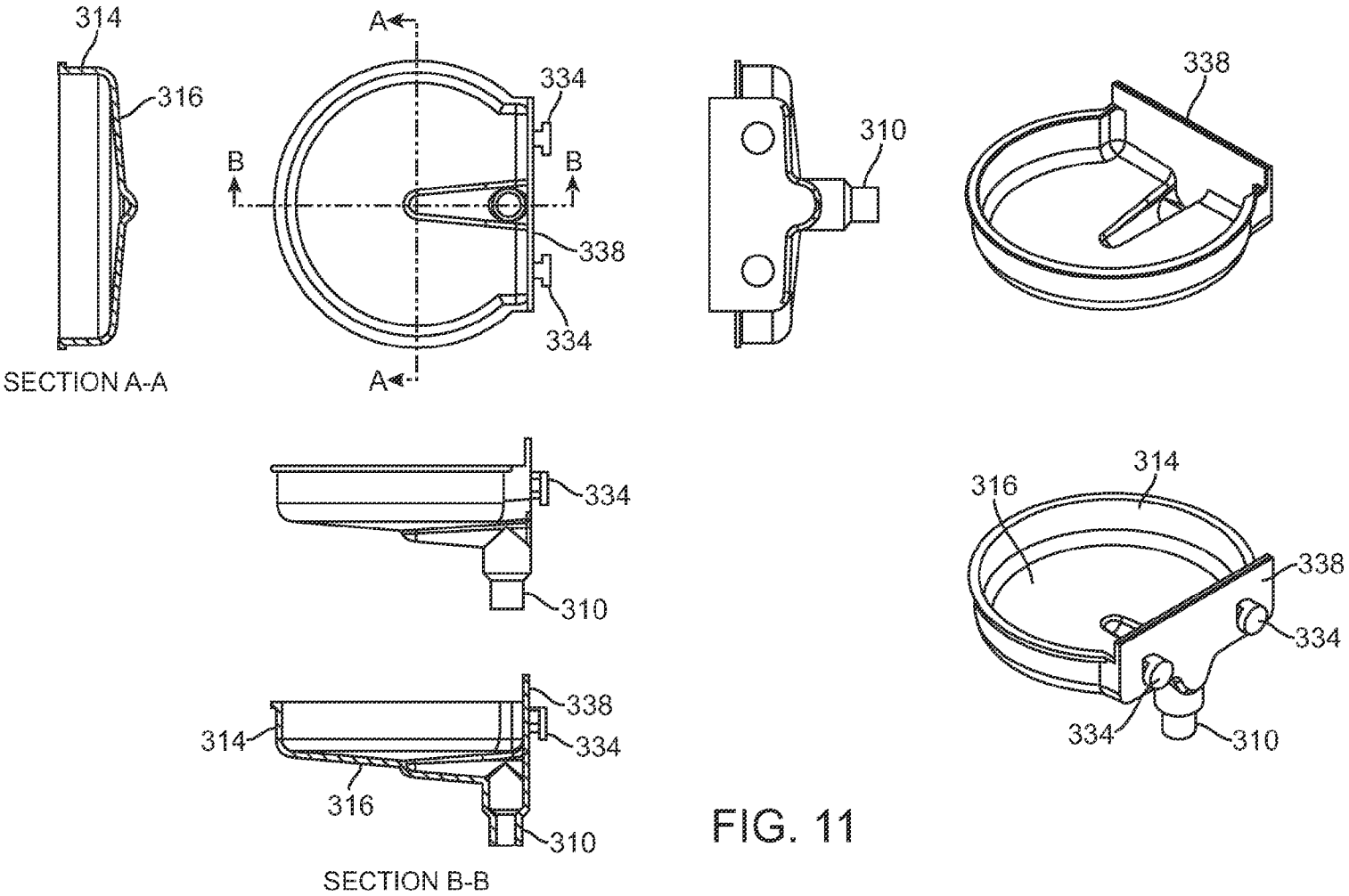
FIG. 11 contains assorted views that show the drip cup of FIGS. 8, 9, and 10.
Figure 12:
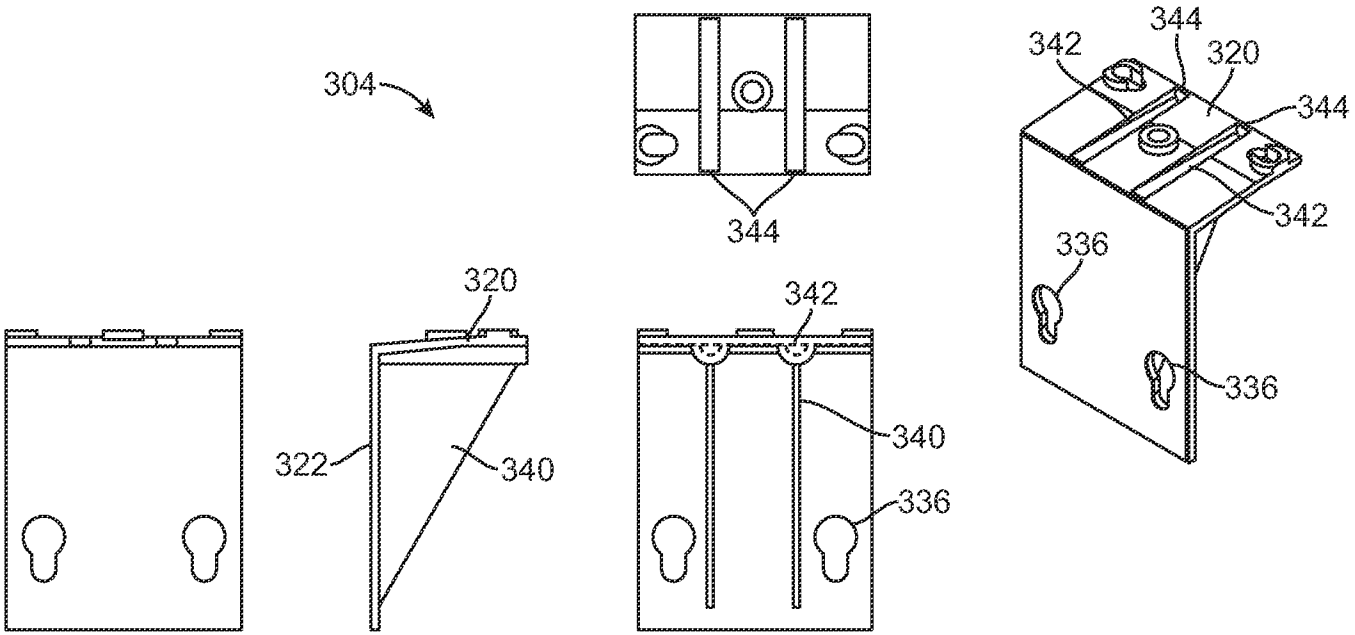
FIG. 12 contains assorted views that show the holder for the drip cup of FIGS. 8, 9, 10, and 11.
Figure 13:
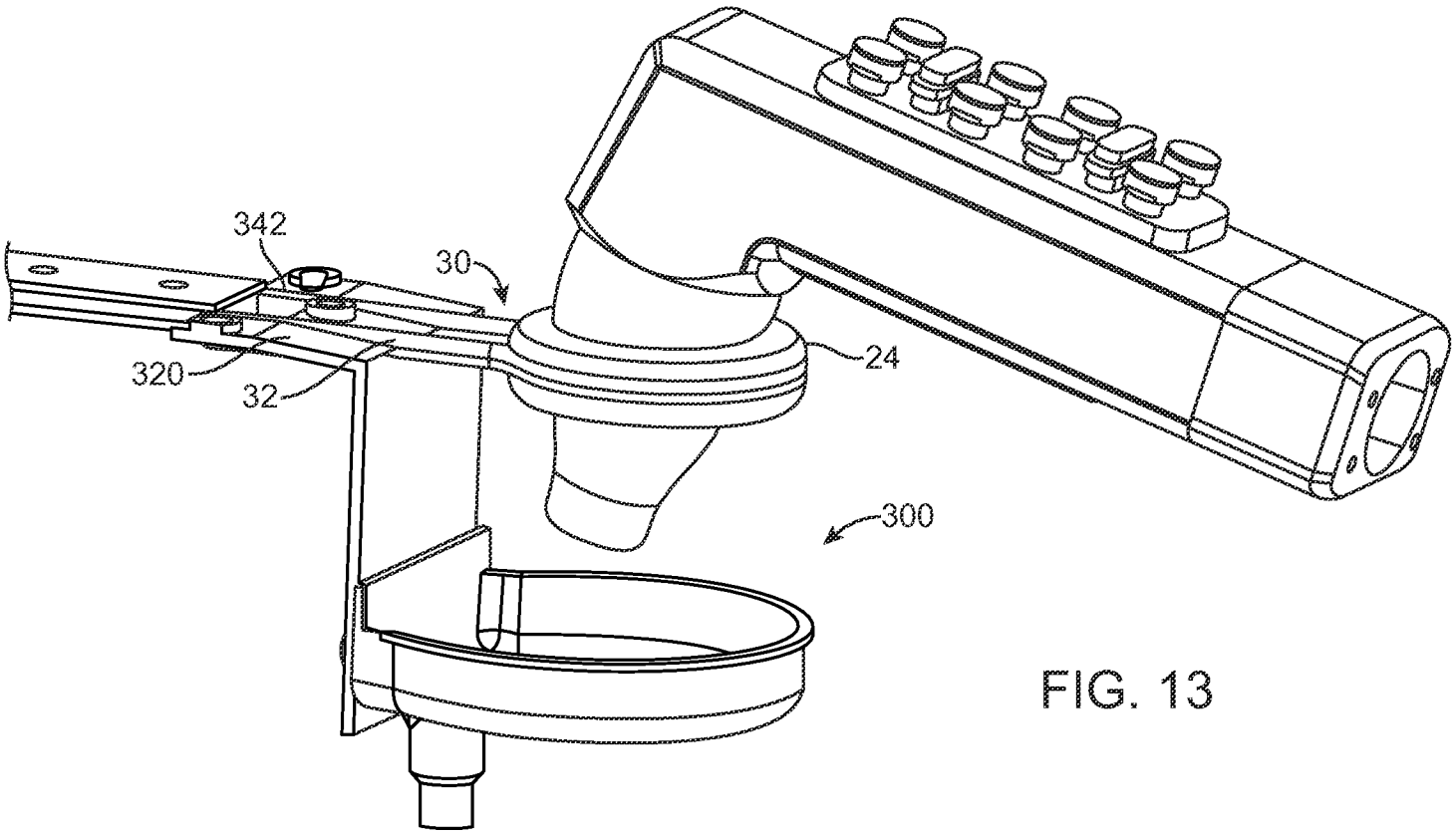
FIG. 13 is a perspective view of the sanitary collection device of FIGS. 8, 9, and 10 used in combination with a wire bar gun holder.
Figure 14:
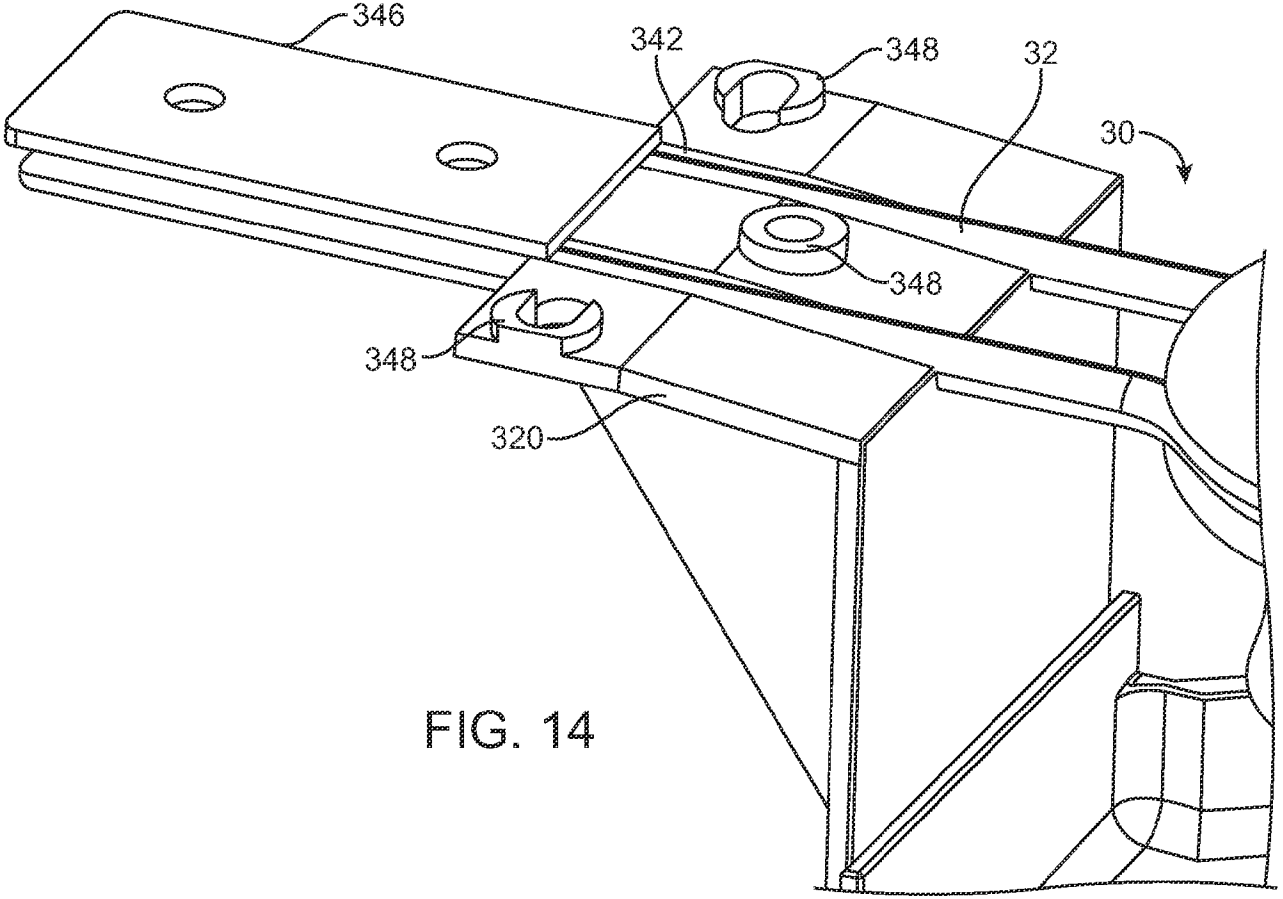
FIG. 14 is a perspective view corresponding to FIG. 13 that depicts the wire bar gun holder positioned in channels provided in the top surface of the holder so the entire assembly can be flush mounted to the underside of a countertop.

FIG. 13 is a perspective view of the sanitary collection device 300 of FIGS. 8, 9, and 10 used in combination with a wire bar gun holder 30 and associated grommet 24. As can be best seen in FIGS. 12 and 14, this embodiment includes channels 342 in the attachment flange 320 configured to interface with the wire frame 32 of the wire bar gun holder 30. As can be seen in FIG. 12, the ends of channels 342 are provided with thin sections 344 that normally prohibit the accumulation of debris in the channels 342 when the sanitary collection device 300 is used with a molded bar gun holder 22. When the wire bar gun holder 30 is used, the thin sections 344 can be removed to provide for the extension of the wire frame 32 beyond the attachment flange 320, as best shown in FIG. 14, where the extended portion of the wire frame 32 is mated with an interface plate 346. The combination of the interface plate 346 and the protruding bosses 348 on the attachment flange 320 provide a planar interface for mounting with the underside of a countertop (not shown).

Figure 15:
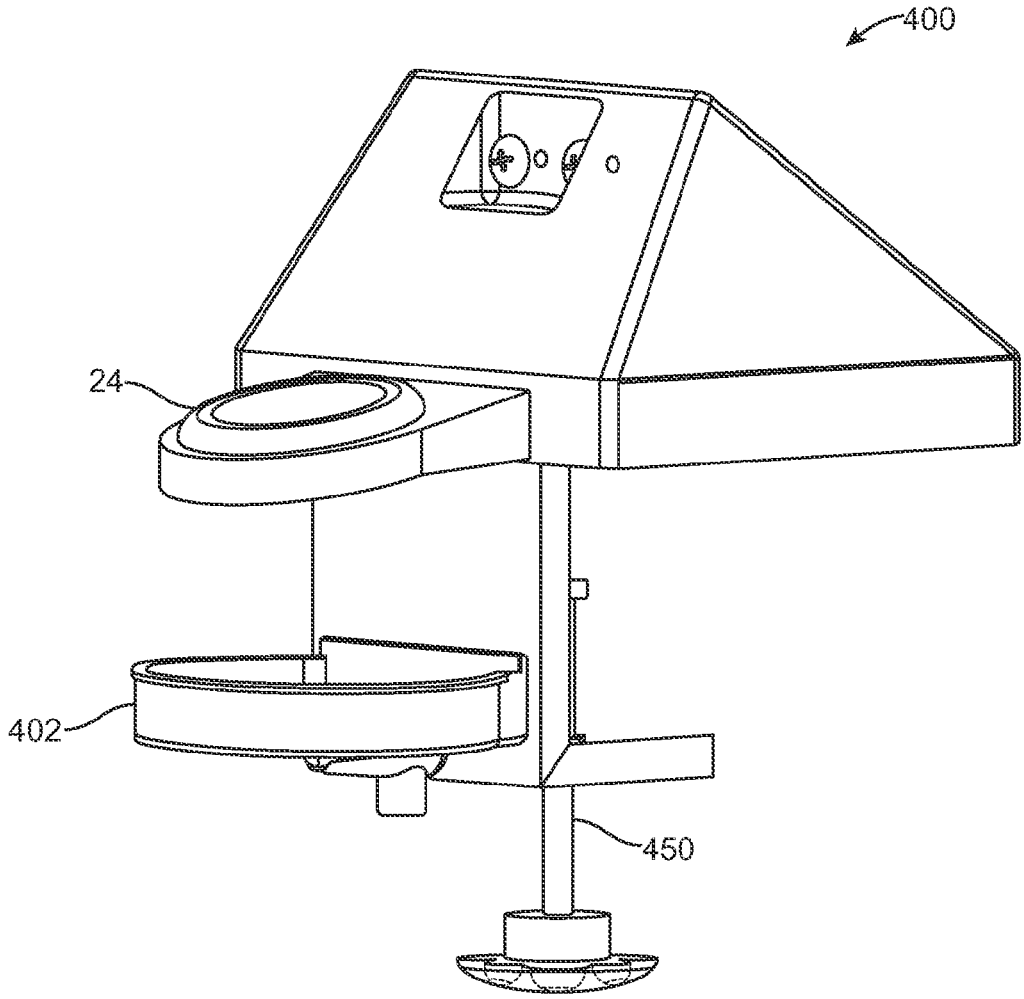
FIG. 15 is a perspective view of a sanitary collection device in accordance with another embodiment of the present invention used in combination with alternate bar gun holder, the combination being configured to be secured to a countertop by way of an attached clamping mechanism.

As can be seen in FIGS. 6 and 7, the attachment flange 220 of the drip cup holder 204 may include mounting holes 252 for attachment fasteners 28 to secure the drip cup holder 204 to the underside of the countertop and/or bar gun holders. As an alternative to the use of attachment fasteners, FIG. 15 shows an alternative embodiment that is configured to be secured to a countertop by way of an attached clamping mechanism 450, thereby allowing the combination bar gun holder and sanitary collection device 400 to be easily relocated to a different location without the need to relocate mounting fasteners. Additionally, this embodiment allows the avoidance of the creation of associated mounting holes in the countertop.

As will be understood by those skilled in the art, the present invention may be embodied in other specific forms without departing from the essential characteristics thereof. These other embodiments are intended to be included within the scope of the present invention, which is set forth in the following claims.

What is claimed is:

1. A beverage dispenser assembly, comprising:

a bar gun comprising a dispensing nozzle;

a bar gun holster comprising an opening configured to interface with the nozzle to hold the bar gun when the bar gun is stowed in the bar gun holster by an operator setting the nozzle in the opening, the bar gun being selectively demountable from the bar gun holster by the operator supporting the bar gun with a hand so as to withdraw the nozzle from the opening, to thereby withdraw the bar gun from the bar gun holster;

a drip cup configured to be removable without the use of tools, comprising:

a drip cup drain spout;

a drip cup bottom side coupled with the drip cup drain spout, the drip cup bottom side configured to channel fluid to the drip cup drain spout;

drip cup surrounding walls coupled with the drip cup bottom side, the drip cup surrounding walls extending upwardly from the periphery of the drip cup bottom side, the drip cup defining a drainage basin configured to intercept and drain the fluid; and a drip cup holder coupled with the bar gun holster, the drip cup holder dimensioned to receive and support the drip cup so as to:

position the drip cup beneath the dispensing nozzle when the bar gun is stowed in the bar gun holster to intercept and drain fluid discharged from the dispensing nozzle, and provide separation between the drip cup and the dispensing nozzle when the bar gun is stowed in the bar gun holster.

2. The assembly of claim 1, wherein the drip cup further comprises an attachment feature and the drip cup holder further comprises a mating attachment feature configured to interface with the drip cup attachment feature.

3. The assembly of claim 2, wherein the drip cup attachment feature is a t-shaped protrusion or a slotted keyway.

4. The assembly of claim 2, further comprising a drain line coupled with the drip cup drain spout.

5. The assembly of claim 1, further comprising a drain line in fluid communication with the drip cup drain spout.

6. The assembly of claim 1, wherein the drip cup holder further comprises an attachment flange for coupling with the bar gun holster.

7. The assembly of claim 6, wherein the attachment flange comprises a channel configured to interface with a portion of the bar gun holster.

8. The assembly of claim 6, wherein the attachment flange comprises one or more mounting holes for attachment fasteners.

9. The assembly of claim 1, wherein the bar gun holster is configured to be clamped to a countertop.

10. The assembly of claim 1, wherein the drip cup holder comprises:

a drip cup holder spout;

a drip cup holder bottom side coupled with the drip cup holder spout; and surrounding drip cup holder walls coupled with the drip cup holder bottom side, the surrounding drip cup holder walls extending upwardly from the periphery of the drip cup holder bottom side, the drip cup holder being sized to cooperatively receive the drip cup and align the drip cup drain spout with the drip cup holder spout.

11. The assembly of claim 10, wherein the bar gun holster is configured to be clamped to a countertop.

12. The assembly of claim 10, further comprising a drain line coupled with the drip cup holder spout.

13. The assembly of claim 12, wherein the drip cup holder further comprises an attachment flange for coupling with the bar gun holster.

14. The device of claim 13, wherein the attachment flange comprises a channel configured to interface with a portion of the bar gun holster.

15. The assembly of claim 13, wherein the attachment flange comprises one or more mounting holes for attachment fasteners.

16. The assembly of claim 1, wherein the drip cup further comprises an interfacing feature configured to interface with a portion of the drip cup holder so as to hold the drip cup in a fixed orientation relative to the drip cup holder.

17. The assembly of claim 16, wherein the interfacing feature is a perimeter lip coupled with the drip cup surrounding walls.

18. The assembly of claim 1, wherein the bar gun holster further comprises a grommet disposed around the opening of the bar gun holster, the grommet being configured to interface with the nozzle to hold the bar gun when the bar gun is stowed in the bar gun holster.

19. The assembly of claim 18, wherein the grommet comprises a perimeter recess configured to interface with the bar gun holster so as to position the grommet within the bar gun holster opening.

20. The assembly of claim 1, wherein the bar gun further comprises a tubing bundle attached to the bar gun.

21. The assembly of claim 1, wherein the bar gun further comprises a generally elongate body, wherein the nozzle extends in a generally transverse direction from the body, wherein the bar gun can be manually moved by the operator between an operative position in which the bar gun is handheld to dispense beverages, and a stowage position in which the bar gun is stowed in the bar gun holster by the operator setting the nozzle in the opening.

22. A beverage dispenser assembly, comprising:

a bar gun comprising a dispensing nozzle;

a bar gun holster comprising an opening configured to interface with the bar gun to hold the bar gun when the bar gun is stowed in the bar gun holster, the bar gun being selectively demountable from the bar gun holster by an operator's hand supporting the bar gun so as to withdraw the bar gun from the bar gun holster, wherein the bar gun holster opening has an opening axis and is oriented such that the opening axis is oriented predominantly vertically when the bar gun holster is operably mounted to a support structure;

a drip cup configured to be removable without the use of tools, comprising:

a drip cup drain spout;

a drip cup bottom side coupled with the drip cup drain spout, the drip cup bottom side configured to channel fluid to the drip cup drain spout;

drip cup surrounding walls coupled with the drip cup bottom side, the drip cup surrounding walls extending upwardly from the periphery of the drip cup bottom side, the drip cup defining a drainage basin configured to intercept and drain the fluid; and a drip cup holder coupled with the bar gun holster, the drip cup holder dimensioned to receive and support the drip cup so as to:

position the drip cup beneath the dispensing nozzle when the bar gun is stowed in the bar gun holster to intercept and drain fluid discharged from the dispensing nozzle, and provide separation between the drip cup and the dispensing nozzle when the bar gun is stowed in the bar gun holster.

* * * * *